US007048317B2

(12) United States Patent
Netsch

(10) Patent No.: US 7,048,317 B2
(45) Date of Patent: May 23, 2006

(54) BELLOWS SCOOP WITH HANDLE

(76) Inventor: Bryan A. Netsch, 444 Remington Pl., Lewisville, TX (US) 75067

( * ) Notice: Subject to any disclaimer, the term of this patent is extended or adjusted under 35 U.S.C. 154(b) by 94 days.

(21) Appl. No.: 10/299,379

(22) Filed: Nov. 19, 2002

(65) Prior Publication Data

US 2004/0094978 A1 May 20, 2004

(51) Int. Cl.
*A47J 43/28* (2006.01)
*G01F 19/00* (2006.01)

(52) U.S. Cl. ..... 294/55; 220/8; 220/666

(58) Field of Classification Search ..... 294/55; 220/8, 6, 574, 666; 73/429; 206/218
See application file for complete search history.

(56) References Cited

U.S. PATENT DOCUMENTS

| | | | | | |
|---|---|---|---|---|---|
| 991,322 | A | | 5/1911 | Kimball | |
| 1,048,411 | A | | 12/1912 | Hutchins | |
| 1,913,652 | A | * | 6/1933 | Alexander | 220/624 |
| 1,975,265 | A | * | 10/1934 | Fulenwider | 220/624 |
| 2,438,434 | A | | 3/1948 | Friedman | |
| 2,685,316 | A | * | 8/1954 | Krasno | 206/524.8 |
| 2,880,902 | A | | 4/1959 | Owsen | |
| 3,143,429 | A | * | 8/1964 | Swanson et al. | 426/117 |
| 3,285,459 | A | | 11/1966 | Gahm | |
| 3,434,589 | A | * | 3/1969 | Valtri et al. | 206/218 |
| 3,471,058 | A | | 10/1969 | Latham et al. | |
| 3,826,409 | A | | 7/1974 | Chilcoate | |
| 3,939,888 | A | * | 2/1976 | Scarnato | 220/666 |
| 4,052,037 | A | * | 10/1977 | Mair et al. | 206/217 |
| 4,184,279 | A | * | 1/1980 | Peilet | 206/232 |
| 4,377,191 | A | * | 3/1983 | Yamaguchi | 220/665 |
| 4,875,576 | A | * | 10/1989 | Torgrimson et al. | 206/219 |
| 6,026,685 | A | | 2/2000 | Weterrings et al. | |
| D439,803 | S | * | 4/2001 | Lin | D7/532 |
| D483,225 | S | * | 12/2003 | Gain | D7/512 |

FOREIGN PATENT DOCUMENTS

| | | | |
|---|---|---|---|
| BR | 9602488 | * | 5/1996 |
| EP | 0 719 708 A1 | | 7/1996 |
| JP | 08-114483 A | * | 5/1996 |
| JP | 9287996 | | 11/1997 |

* cited by examiner

*Primary Examiner*—Eileen D. Lillis
*Assistant Examiner*—Paul T. Chin
(74) *Attorney, Agent, or Firm*—Luedeka, Neely & Graham PC

(57) ABSTRACT

A scoop expandable into a configuration including a handle section attached to a bellows section. The bellows section includes a plurality of slant wall sections and thin wall sections attached between adjacent slant wall sections defining peaks and valleys between adjacent slant wall sections, and a center bottom section attached to an adjacent slant wall section. A height dimension of the scoop in an unexpanded state ranges from about 2.5 to about 12.5 millimeters. The scoop is suitable for use in packaging granulated materials under high speed, high pressure, or space-limited packaging conditions.

10 Claims, 5 Drawing Sheets

BELLOWS SCOOP WITH HANDLE

FIELD OF THE INVENTION:

The invention relates to a bellows scoop for use with granulated products and in particular to a scoop that is configured for pressure-packed or space-limited packaging processes for granulated materials.

BACKGROUND

Rigid scoops are typically packaged with granulated materials such as food, laundry detergent, coffee, fertilizer and the like for measuring quantities of the materials for use. However, rigid scoops have a fixed volume receptacle section that can be damaged during packaging of the granulated materials if too much pressure is applied to receptacle section of the scoop. Another limitation of rigid scoops is that for some packaging processes such as coffee packaging, the packaging equipment is disposed in the packages to within about one quarter inch of a lower wall of the package whereby a conventional scoop would be crushed during the packaging operation. There is a need therefore, for an improved scoop that can be inserted in a package for granulated materials packed under high pressure conditions or space-limited packaging processes and that can be expanded to a desirable volume for use in scooping granulated materials once the granulated material package is opened.

SUMMARY OF THE INVENTION

With regard to the foregoing and other objects and advantages, the invention provides a scoop expandable into a configuration, the scoop including a handle section attached to a bellows section. The bellows section includes a plurality of slant wall sections and thin wall sections attached between adjacent slant wall sections defining peaks and valleys between adjacent slant wall sections, and a center bottom section attached to an adjacent slant wall section. A height dimension of the scoop in an unexpanded state ranges from about 2.5 to about 12.5 millimeters. The scoop is suitable for use in packaging granulated materials under high pressure packaging conditions.

An advantage of the scoop of the invention is that the scoop has a relatively flat or substantially two-dimensional configuration that enables the scoop to be inserted in a package of granulated material without substantially crushing or deforming the scoop. By "relatively flat" is meant that a height dimension of the scoop in its unexpanded state is no more than about 12.5 millimeters. Upon removal from the package, the scoop may be expanded to provide a volume for measuring the granulated material. Another advantage of the scoop is that a variable volume of the scoop may be selected by a user by expanding more or less of an expandable bellows section of the scoop. Still another advantage of the scoop is that it enables the scoop to be inserted by a high speed insertion machine in a variety of packages.

BRIEF DESCRIPTION OF THE DRAWINGS

Further features and advantages of the invention will become apparent by reference to the detailed description when considered in conjunction with the figures, which are not to scale, wherein like reference numbers indicate like elements through the several views, and wherein.

DETAILED DESCRIPTION OF THE PREFERRED EMBODIMENTS

Figures 1A, 1B, 2:
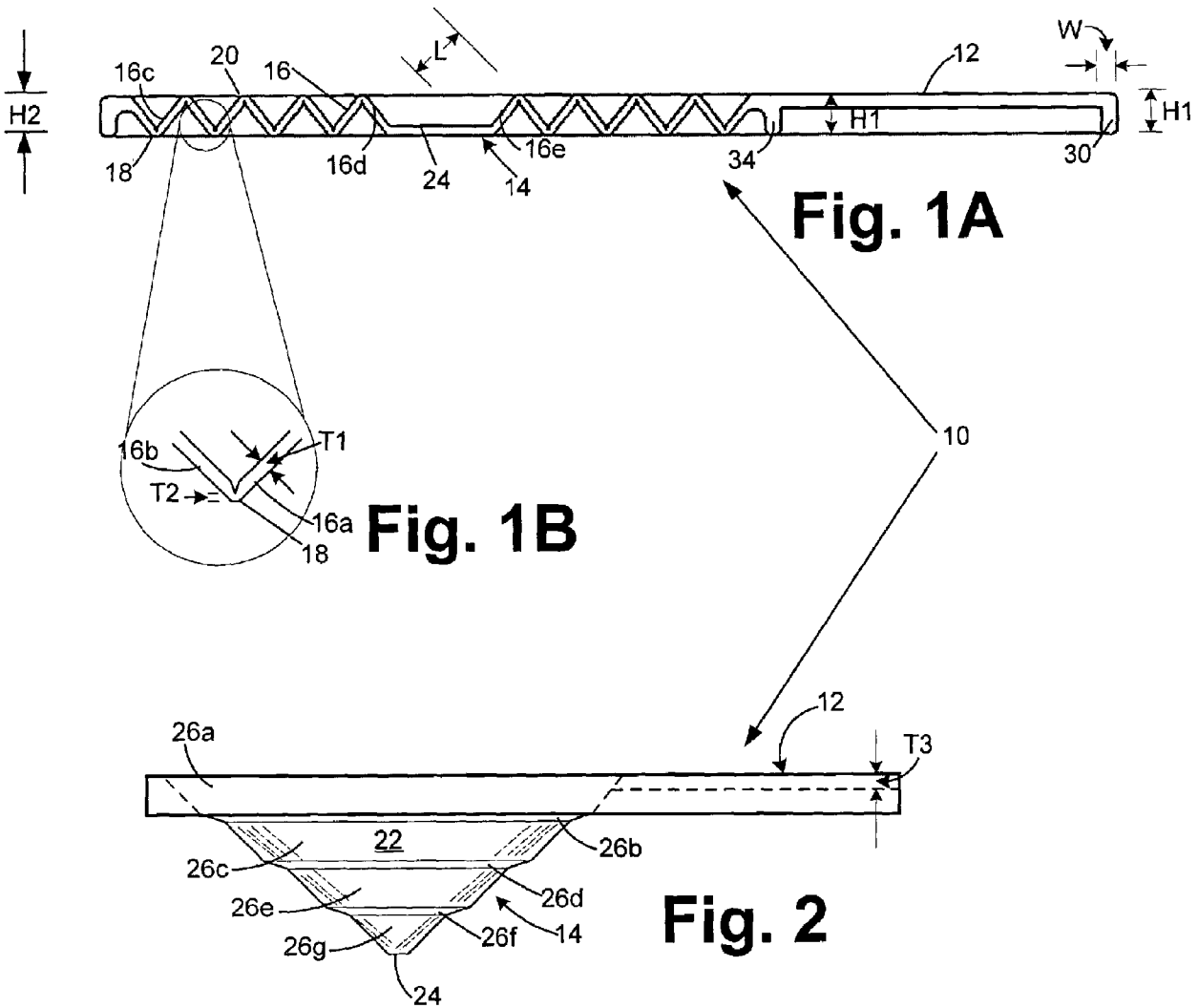
FIG. 1A is a cross-sectional view, not to scale of a bellows scoop according to the invention.
FIG. 1B is a cross-sectional view, not to scale of a portion of a bellows scoop according to the invention.
FIG. 2 is a side elevational view, not to scale, of a scoop according to the invention after expanding the bellows section.

With reference to FIGS. 1A and 1B, various aspects of the invention are illustrated. A bellows scoop 10 of the invention is preferably of one-piece molded plastic construction and includes a handle section 12 and a bellows section 14. Thermoplastic materials are most useful for making the scoop 10. Such thermoplastic materials may be selected from a wide variety of materials including, but not limited to polyolefins, such as polyethylene and polypropylene, polyesters, polyamides, acetals, acrylates, acrylonitrile, fluoropolymers, phthalates, polyarylates, polycarbonates, polyethers, polyphenylene sulfides, polystyrenes, polysulfones, and the like. A particularly preferred thermoplastic material is polypropylene. The thermoplastic material is preferably injection molded to form the bellows scoop 10 under conventional injection molding conditions.

The bellows section 14 of the scoop 10 includes a plurality of slant wall sections 16. Adjacent slant wall sections 16 such as sections 16*a* and 16*b*, FIG. 1B, are connected together by thin wall sections, such as sections 18, and adjacent slant wall section 16*b* and 16*c* are connected together by thin wall sections such as section 20. Section 18 is hereinafter referred to as a valley between adjacent slant wall sections 16*a* and 16*b*. Section 20 is hereinafter referred to as a peak between adjacent slant wall sections 16*b* and 16*c*. A center bottom section 24 is provided between slant wall sections 16*d* and 16*e* toward a center portion of the bellows section 14.

The thin wall sections 18 and 20 enable the bellows section 14 to be easily formed into an expanded bellows section 22 as shown in FIG. 2. The volume of the expanded bellows section 22 is related to the number of slant wall sections 16 between the handle section 12 and the center bottom section 24 and the diameter of the bellows section 14. It is preferred that the peaks 20 be spaced apart a distance of at least about 3 millimeters, preferably from about 4.5 to about 6.5 millimeters for slant wall sections 16 having a length L ranging from about 3 millimeters to about 6.5 millimeters, preferably from about 3 millimeters to about 4.8 millimeters. Not all of the slant wall sections 16 need have the same length L. Accordingly, adjacent slant wall sections such as sections 16*a* and 16*b* may have a different length L. The overall size or diameter D of the bellows section 14 (FIG. 3) preferably ranges from about 31 millimeters to about 100 millimeters.

Each of the slant wall sections such as section 16*b* (FIG. 1B) preferably has a thickness T1 of thermoplastic material ranging from about 0.3 millimeters to about 2.0 millimeters, and more preferably from about 0.5 to about 1.0 millimeter. The thickness T2 of the thin wall sections 18 and 20 preferably ranges from about 0.1 millimeter to about 1.0 millimeter. The thicknesses T1 and T2 may vary in relation to the thermoplastic material. For example, use of a more elastic thermoplastic material may enable thicker slant wall sections 16 and thin wall sections 18 and 20 whereas use of a less elastic thermoplastic material may require thinner slant wall sections 16 and thin wall sections 18 and 20. The thickness T2 of the thin wall sections 18 and 20 preferably ranges from about 35 to about 75 percent, more preferably about 50 percent of the thickness T1 of the slant wall sections 16

The thickness T1 of the slant wall sections 16 and the thickness T2 of the thin wall sections 18 and 20 are also related to the diameter D of the bellows section 14 wherein the ratio of the diameter D to the thickness T1 preferably ranges from about 40:1 to about 100:1 and the ratio of the diameter D to the thickness T2 preferably ranges from about 50:1 to about 500:1.

Figure 3:
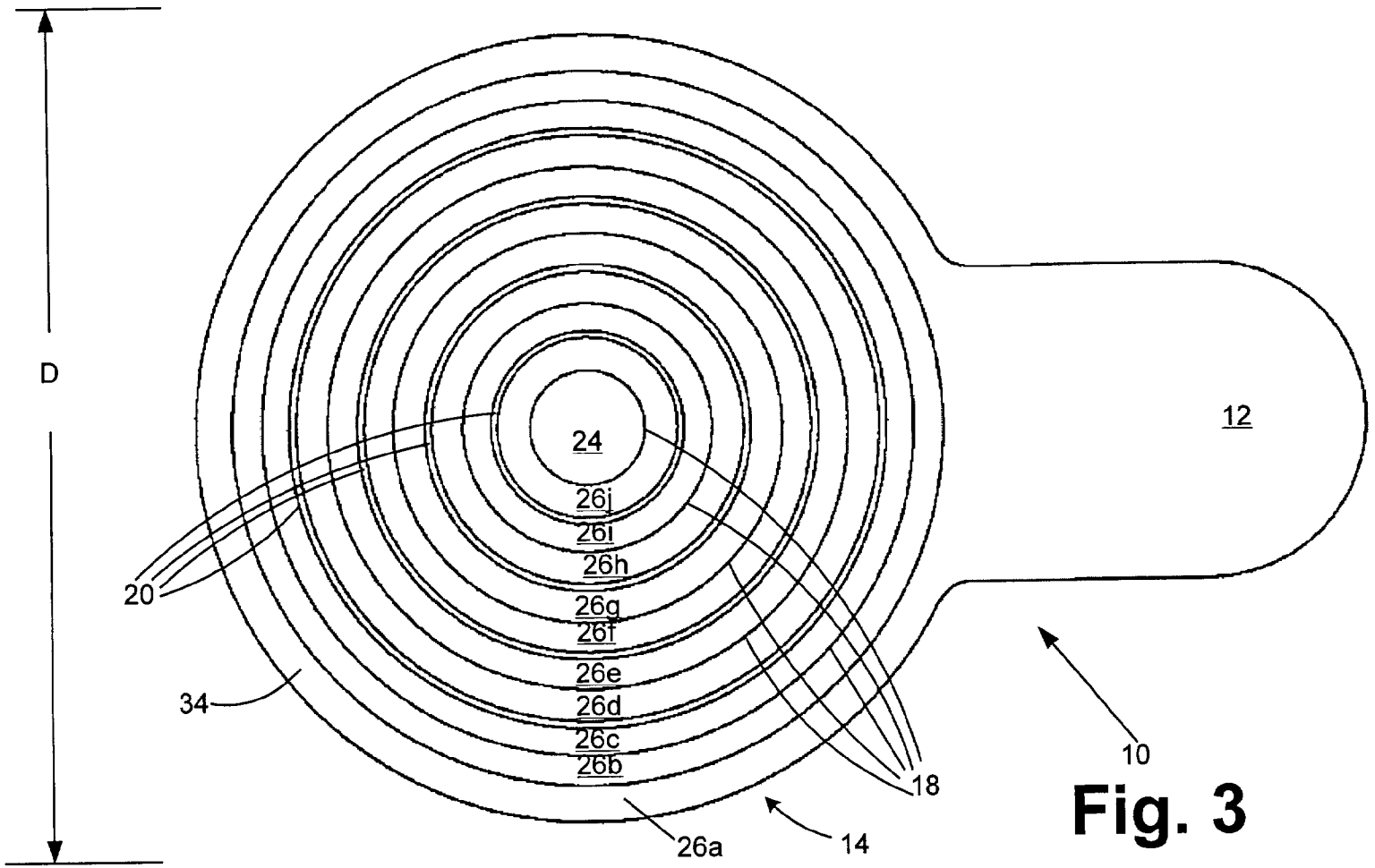
FIG. 3 is a top plan view, not to scale, of a scoop according to the invention.
Figure 4:
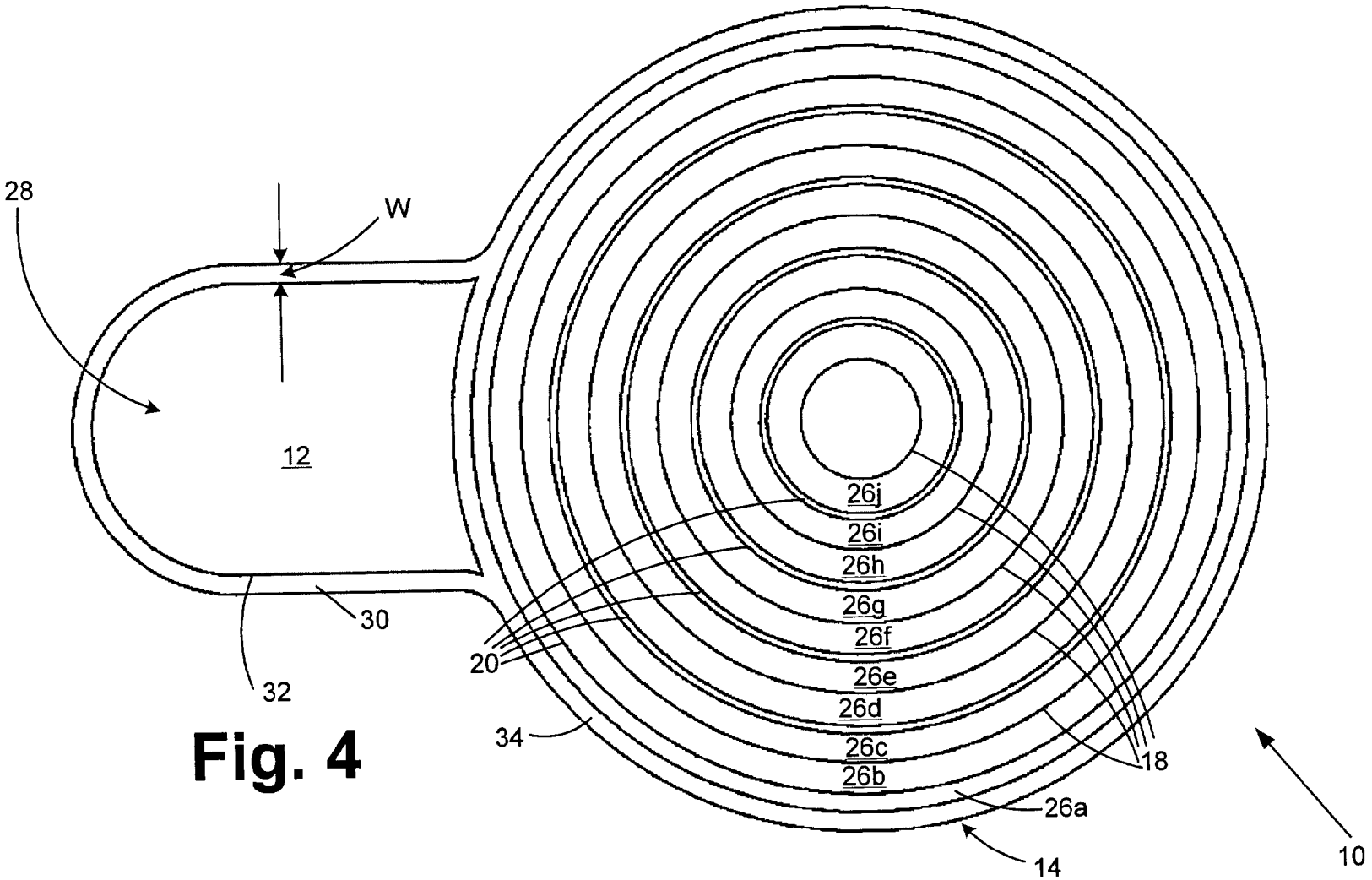
FIG. 4 is a bottom plan view, not to scale, of a scoop according to the invention.

Other features of the invention are illustrated in FIGS. 3 and 4. FIGS. 3 and 4 are plan views from the top and bottom respectively of a scoop 10 according to the invention having a round or circular bellows section 14. The slant wall sections 16, valleys 18, and peaks 20 provide concentric sections 26*a*–26*i* running from the handle section 12 to the center bottom section 24. It will be appreciated that the thickness T1 of the slant wall sections 16 and the thickness T2 of the thin wall sections 18 and 20 may vary when moving from concentric section 26*a* to concentric section 26*i*. Thicker slant wall sections 16 and thicker thin wall sections 18 and 20 will generally be present in the outer concentric wall sections 26*a*–26*c* as compared to inner concentric wall sections 26*h*–26*i*.

It is preferred that the entire scoop 10 be made from a single thermoplastic material and that the handle section 12 be thicker than the slant wall sections 16 and the valleys 18 and peaks 20. A thickness T3 of the handle section 12 preferably ranges from about 0.5 to about 1.5 millimeters, preferably from about 0.8 to about 1.2 millimeters. If the thickness T3 of the handle section 12 is less than about 1.2 millimeters, then it is preferred to reinforce the handle section 12 by a ridge portion 30 discussed below.

As shown in FIG. 4, the handle section 12 may include a planar portion 28 and a ridge portion 30 adjacent a perimeter 32 of the planar portion 28. A ridge portion 34 also preferably surrounds the bellows section 14 and provides rigidity to that section. The ridge portions 30 and 34 preferably have a height dimension H1 ranging from about 2.5 to about 12.5 millimeters, and a width dimension W of at least about 1 millimeter. The height dimension H1 is preferably the same as a height dimension H2 of the overall scoop 10 in its unexpanded state as shown in FIG. 1. In other words, the slant wall sections 16 have a length L that enables the height dimension H2 to be within the preferred range so that the scoop 10, in its unexpanded stated is relatively flat.

Figure 5:
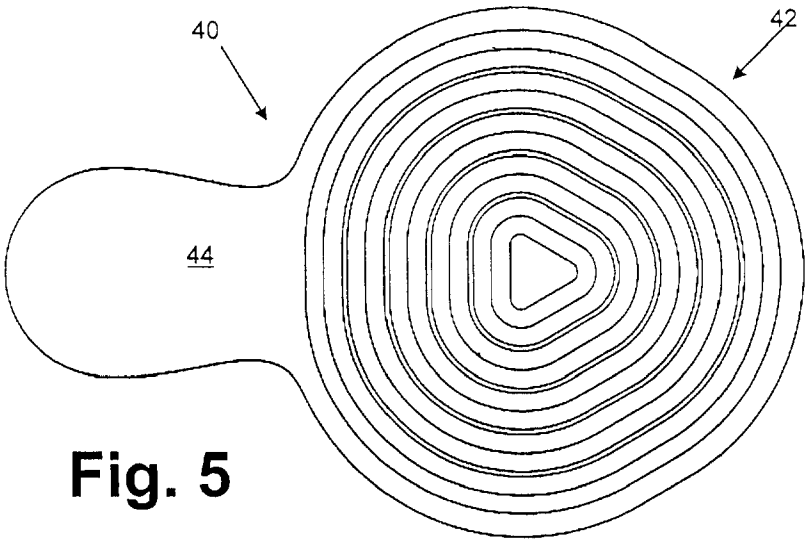
FIG. 5 is a top plan view, not to scale, of a scoop having a substantially triangular shaped bellows section according to the invention.
Figure 6:
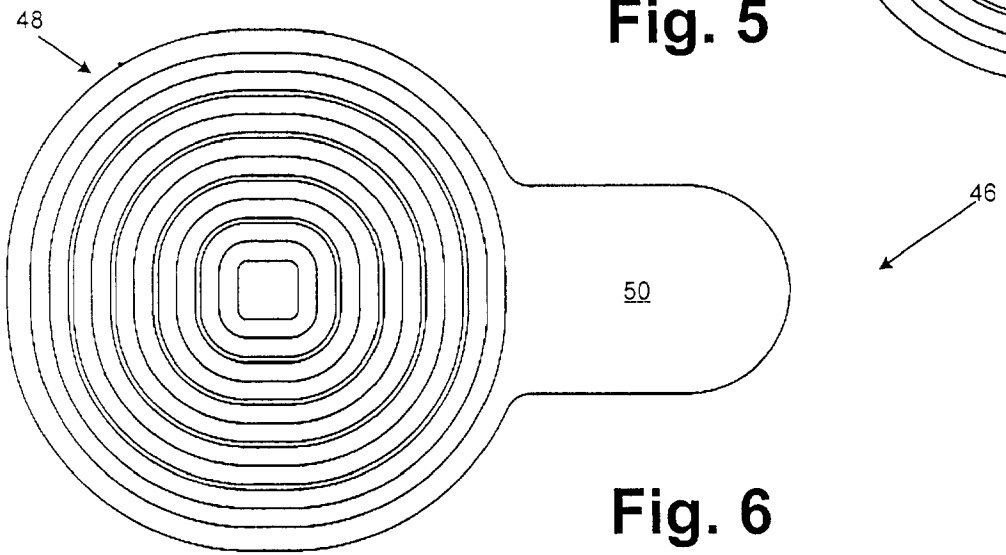
FIG. 6 is a top plan view, not to scale, of a scoop having a substantially rectangular shaped bellows section according to the invention.
Figure 7:
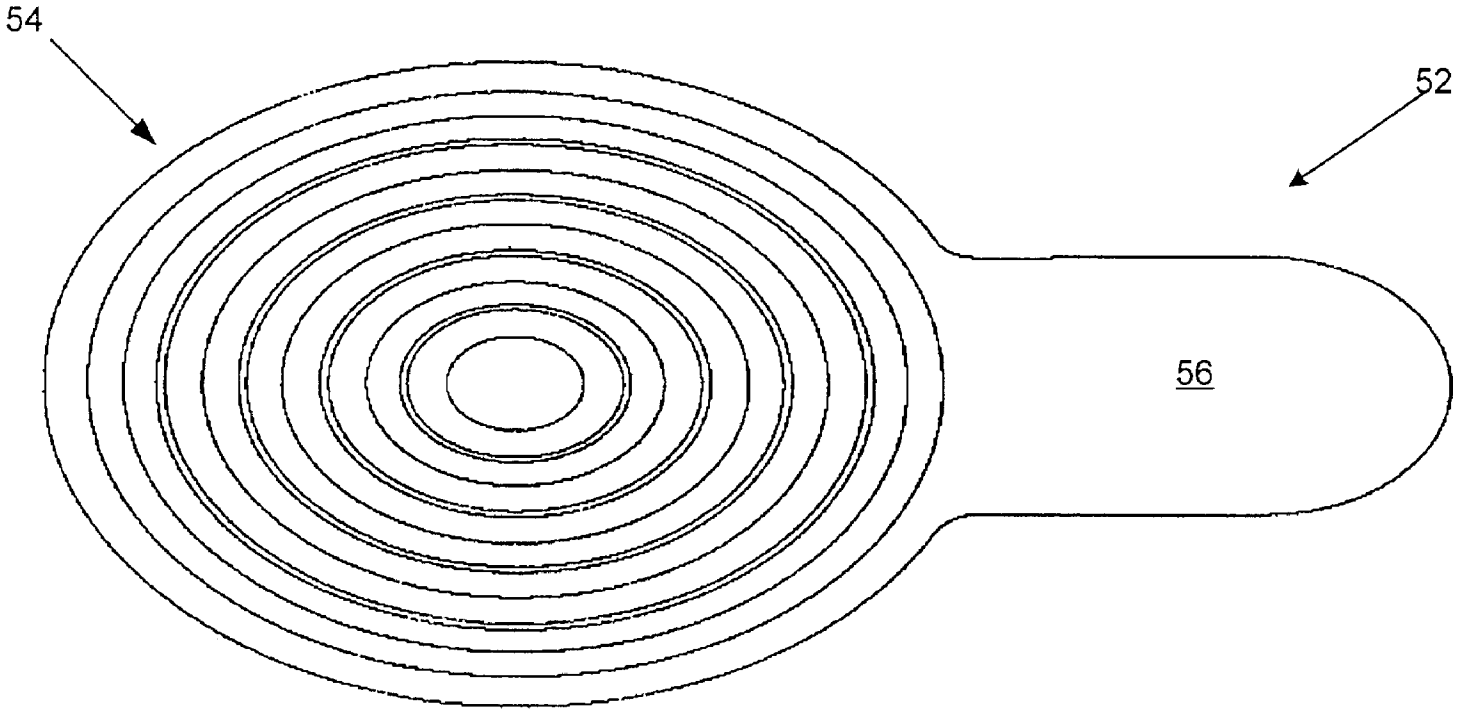
FIG. 7 is a top plan view, not to scale, of a scoop having a substantially oval shaped bellows section according to the invention.

Other configurations of scoops according to the invention are illustrated in FIGS. 5 and 6 for example. Scoop 40 has a substantially triangular shaped bellows section 42 and a handle section 44 attached to the bellows section 42. Scoop 46 has a substantially rectangular bellows section 48 and a handle section 50 attached to the bellows section 48. Scoop 52 has a substantially oval shaped bellows section 54 and a handle section 56 attached to the bellows section 54. In all other respects, the scoops 40, 46 and 52 are similar to scoop 10 described above.

The scoops 10, 40, 46, and 52 according to the invention, are particularly suitable for insertion in a package of granulated material, in their unexpanded state under high pressure packaging conditions, during high speed insertion processes, or by using space-limited packaging devices. The overall low profile of the unexpanded scoops 10, 40, 46, and 52 of the invention make the scoops particularly suitable for use with conventional high speed package insertion devices as would typically be used for inserting premiums, games, coupons, etc. into food and other packages.

While the invention has been described in detail, it is to be expressly understood that various changes of form, design or arrangement may be made to the invention by those skilled in the relevant art without departing from the spirit and scope of the invention. Therefore, the above mentioned description is to be considered exemplary, rather than limiting, and the scope of the invention is defined by the following claims.

What is claimed is:

1. An expandable scoop comprising:

a unitary molded body including a bellows section, the bellows section being provided by a first ridge portion surrounding a plurality of slant wall sections and thin wall sections attached between adjacent slant wall sections, the thin wall sections defining peaks and valleys between adjacent slant wall sections, a handle section attached to the bellows section, the handle section including a planar portion and a second ridge portion adjacent a perimeter of the planar portion, and a center bottom section attached to one of the slant wall sections, wherein a height dimension of the scoop in an unexpanded state ranges from about 2.5 to about 12.5 millimeters, and wherein the bellows section including the first ridge portion has an overall height dimension that is substantially the same as a height dimension of the second ridge portion so that the scoop has a substantially single overall height dimension in the unexpanded state.

2. The scoop of claim 1 containing at least three peaks and at least three valleys and corresponding slant wall sections attached to the peaks and valleys.

3. The scoop of claim 1 containing at least four peaks and at least four valleys and corresponding slant wall sections attached to the peaks and valleys.

4. The scoop of claim 1 wherein the bellows section is substantially circular.

5. The scoop of claim 4 wherein the bellow section has a diameter of about 50 millimeters or more.

6. The scoop of claim 1 having a bellows section diameter to slant wall thickness ratio ranging from about 40:1 to about 100:1.

7. The scoop of claim 1 having a bellows section diameter to thin wall thickness ratio ranging from about 50:1 to about 500:1.

8. The scoop of claim 1 having a variable expanded volume.

9. The scoop of claim 1 wherein the thin wall sections have a material thickness ranging from about 0.1 to about 1.0 millimeter.

10. The scoop of claim 1 wherein the slant wall sections have a material thickness ranging from about 0.3 to about 2.0 millimeters.

* * * * *